United States Patent [19]

Rothenstein et al.

[11] 4,040,880

[45] Aug. 9, 1977

[54] PERCHLORATE SENSITIZING AGENT

[75] Inventors: Julius Rothenstein, Carmichael; G. A. Zimmerman, Sacramento, both of Calif.

[73] Assignee: The United States of America as represented by the Secretary of the Navy, Washington, D.C.

[21] Appl. No.: 375,244

[22] Filed: June 28, 1973

[51] Int. Cl.[2] ..... C06B 31/28

[52] U.S. Cl. ..... 149/76; 149/75; 149/92; 149/77

[58] Field of Search ..... 149/75, 76, 40, 77

[56] References Cited

U.S. PATENT DOCUMENTS 3,259,531 7/1966 Lofberg ..... 149/76

*Primary Examiner*—Stephen J. Lechert, Jr.

*Attorney, Agent, or Firm*—R. S. Sciascia; A. L. Branning

[57] ABSTRACT

An inorganic perchlorate is sensitized by adding about 1–8 percent by weight of copper chromite to said perchlorate. The mixture of inorganic perchlorate-copper chromite can be used as a substitute for RDX.

10 Claims, No Drawings

PERCHLORATE SENSITIZING AGENT

BACKGROUND OF THE INVENTION

This invention generally relates to explosive compositions and more particularly to explosive compositions containing inorganic perchlorates.

Many explosives presently in use utilize RDX as an essential ingredient since this explosive composition is usually necessary to attain relatively high energy levels. Due to this extensive use, however, RDX is presently in rather short supply. In view of this, suitable replacements for this material have been sought so that this critical shortage could be relieved. Among the approaches used to find such a replacement material has been a search for materials which would act as sensitizing agents for other readily available materials such as, for example, sensitizing agents for ammonium perchlorate or other inorganic perchlorates.

SUMMARY OF THE INVENTION

Accordingly, one object of this invention is to provide an explosive composition.

Another object of this invention is to provide a method of sensitizing a readily available explosive material.

Yet another object of this invention is to provide an explosive composition that has an energy level similar to that A further object of this invention is to provide an explosive composition which can be used as a replacement for RDX.

A still further object of this invention is to provide a material which can be used to replace RDX in order to relieve the shortage of this material.

These and other objects of this invention are accomplished by providing an explosive composition comprising an inorganic perchlorate and 1–8 weight percent copper chromite wherein said percentage of copper chromite is based on the weight of inorganic perchlorate.

DESCRIPTION OF THE PREFERRED EMBODIMENT

The sensitized explosive composition of this invention which has an energy level roughly equal to that of RDX comprises an inorganic perchlorate and about 1–8 weight percent copper chromite ($CuCr_2O_4$). It is preferable to have about 1–5 weight percent of copper chromite based on the weight of the inorganic perchlorate and the most preferred perchlorate is ammonium perchlorate.

Although the sensitized compositions of this invention can be used to replace all of the RDX in an explosive composition it is usually desirable to have it replace only a portion of the RDX. A particularly good combination of ingredients in addition to the ammonium perchlorate and copper chromite include RDX, aluminum, a binder comprising a readily curable prepolymer, a crosslinker which may optionally be identical to the prepolymer, a curing agent, a catalyst or other desired additive, and a compatible energetic plasticizer diluent such as bis(2,2-dinitropropyl) formal and bis(2,2-dinitropropyl) acetal. The general nature of the invention having been set forth, the following example is presented as specific illustration thereof. It will be understood that the invention is not limited to this specific example but is susceptible to various modifications that will be recognized by one of ordinary skill in the art.

EXAMPLE

A 550 gram size batch of explosive composition was prepared by mixing at 135°–140° F, 49.8 weight percent ammonium perchlorate, 5 weight percent RDX, 25.8 weight percent aluminum powder and 2 weight percent copper chromite (this quantity is about 4 weight percent based on ammonium perchlorate) with a prepolymer portion comprising 15 equivalents of polyoxyethylene glycol (equivalent weight 2217), 85 equivalents of trimethylol propane (equivalent weight 45) and 107 equivalents of tolylene diisocyanate (equivalent weight 87) plasticized 75 weight percent with a 1:1 mixture of bis (2,2-dinitropropyl) formal and bis(2,2-dinitropropyl) acetal and containing 0.25 weight percent phenylbeta-naphthylamine antioxidant and 0.01 weight percent of ferric acetylacetonate catalyst.

It should be noted that the sensitized explosive composition of this invention can be used in any explosive composition and is particularly useful in explosive compositions which utilize RDX.

Obviously, numerous modifications and variations of the present invention are possible in light of the above teaching. It is therefore understood that within the scope of the appended claims the invention may be practiced otherwise than as specifically described herein.

What is claimed as new and desired to be secured by Letters Patent of the United States is:

1. The method of sensitizing inorganic perchlorate salts comprising mixing said salts with about 1–8 percent by weight of copper chromite, said weight being based on the weight of inorganic perchlorate.

2. The method of claim 1 wherein the quantity of copper chromite is about 1–5 weight percent.

3. The method of claim 1 wherein said perchlorate salt is ammonium perchlorate.

4. The method of claim 2 wherein said perchlorate salt is ammonium perchlorate.

5. An explosive composition consisting of an inorganic perchlorate and about 1–8 weight percent of copper chromite based on the weight of said inorganic perchorate.

6. The composition of claim 5 wherein said copper chromite constitutes about 1–5 weight percent of the perchlorate.

7. The composition of claim 5 wherein said inorganic perchlorate is ammonium perchlorate.

8. The composition of claim 6 wherein said inorganic perchlorate is ammonium perchlorate.

9. The composition of claim 5 which has an energy level roughly equal to that of cyclotrimethylenetrinitramine (RDX).

10. The composition of claim 5 which has an energy level roughly equal to that of cyclotrimethylenetrinitramine (RDX).

* * * * *